US011292696B2

(12) United States Patent
Vicente et al.

(10) Patent No.: US 11,292,696 B2
(45) Date of Patent: Apr. 5, 2022

(54) ELEVATOR CAR

(71) Applicant: Otis Elevator Company, Farmington, CT (US)

(72) Inventors: Marta Vicente, Badajoz (ES); Juan Jose Fernandez, Madrid (ES)

(73) Assignee: OTIS ELEVATOR COMPANY, Farmington, CT (US)

( * ) Notice: Subject to any disclaimer, the term of this patent is extended or adjusted under 35 U.S.C. 154(b) by 111 days.

(21) Appl. No.: 16/521,230

(22) Filed: Jul. 24, 2019

(65) Prior Publication Data

US 2020/0031625 A1 Jan. 30, 2020

(30) Foreign Application Priority Data

Jul. 30, 2018 (EP) ..... 18186303

(51) Int. Cl.
*B66B 11/02* (2006.01)
*B66B 5/02* (2006.01)

(52) U.S. Cl.
CPC ..... *B66B 11/0226* (2013.01); *B66B 5/027* (2013.01)

(58) Field of Classification Search
CPC .. B66B 5/027; B66B 11/0246; B66B 11/0226
See application file for complete search history.

(56) References Cited

U.S. PATENT DOCUMENTS 7,469,773 B2 12/2008 Yoon
7,575,098 B2 8/2009 Hartley
8,925,980 B2 1/2015 Heikintupa et al.
9,193,566 B1 11/2015 Nieves et al.
2018/0105394 A1* 4/2018 Hill ..... B66B 11/0226

FOREIGN PATENT DOCUMENTS

CN 102515000 B 10/2013
CN 203345875 U 12/2013
CN 205527201 U 8/2016
EP 1533265 A1 5/2005
EP 1982944 A1 10/2008
(Continued)

OTHER PUBLICATIONS

Machine Translation of JP 2008-044734.*
(Continued)

*Primary Examiner* — Diem M Tran
(74) *Attorney, Agent, or Firm* — Cantor Colburn LLP

(57) ABSTRACT

Elevator car (6) comprising an interior space (10) for accommodating passengers and/or cargo, a structural ceiling (20) arranged at the top of the elevator car (6) and comprising at least one rescue opening (21), and a decorative ceiling (22) arranged below the structural ceiling (20) within the interior space (10). The decorative ceiling (22) is movable between a closed position in which it extends basically parallel to the structural ceiling (20) and at least one open position in which it extends into the interior space (10). The elevator car (6) further comprises a control element (30) which is selectively attachable to the structural ceiling (20) and to the decorative ceiling (22), respectively. The control element (30), when attached to the decorative ceiling (22), allows moving the decorative ceiling (22) between its closed position and an open position in a controlled manner.

14 Claims, 10 Drawing Sheets

(56) References Cited

FOREIGN PATENT DOCUMENTS

| | | | | |
|---|---|---|---|---|
| EP | 1988049 | A1 | 11/2008 | |
| EP | 1728753 | B1 | 7/2009 | |
| EP | 2456704 | B1 | 4/2016 | |
| JP | S50124064 | A | 10/1975 | |
| JP | S5193039 | A | 8/1976 | |
| JP | S53109356 | A | 9/1978 | |
| JP | 2001171932 | A | 6/2001 | |
| JP | 2008044734 | A | 2/2008 | |
| WO | WO-2006126254 | A1 * | 11/2006 | ..... B66B 11/0226 |

OTHER PUBLICATIONS

Centerpointe Modereator, "Centerpointe Communicator: Replacing the cord on pull-down attic stairs", available at: http://centerpointeleaguecity.blogspot.com/2013/04/replacing-cord-on-pull-down-attic-stairs.html, Apr. 21, 2013, 8 pages.
European Search Report for application 18186303.6, dated Feb. 22, 2019, 9 pages.
Chinese Office Action for Application No. 201910694571.2; dated Aug. 31, 2020; 10 Pages.

* cited by examiner

ELEVATOR CAR

FOREIGN PRIORITY

This application claims priority to European Patent Application No. 18186303.6, filed Jul. 30, 2018, and all the benefits accruing therefrom under 35 U.S.C. § 119, the contents of which in its entirety are herein incorporated by reference.

BACKGROUND

The invention relates to an elevator car, and to a method of providing access to an elevator car. The invention in particular relates to an elevator car comprising a decorative ceiling and providing access to the interior of the elevator car from the top of the elevator car. The invention further relates to an elevator system comprising such an elevator car.

An elevator system typically comprises at least one elevator car moving along a hoistway extending between a plurality of landings, and a driving member configured for driving the elevator car. Passengers may enter and leave the elevator car via an elevator car door. The elevator car door opens when the elevator car is positioned at one of the landings.

It would be beneficial to provide alternative access to the interior of the elevator car in order to allow entering and/or leaving the elevator car in case of a malfunction and/or emergency situation, which does not allow entering or leaving the elevator car via the elevator car door.

BRIEF DESCRIPTION

According to an exemplary embodiment of the invention, an elevator car comprises an interior space for accommodating passengers and/or cargo; a structural ceiling arranged at the top of the elevator car and comprising at least one rescue opening; and a decorative ceiling arranged below the structural ceiling within the interior space. The decorative ceiling is movable between a closed position in which it extends basically parallel to the structural ceiling, and at least one open position in which it extends into the interior space. The elevator car further comprises a control element, in particular a tension element, which is selectively attachable to the structural ceiling and to the decorative ceiling, respectively. When attached to the decorative ceiling, the control element allows moving the decorative ceiling between its closed position and an open position in a controlled manner. The control element in particular allows controlling the movement of the decorative ceiling from a position outside the elevator car, e.g. from a position above/on top of the elevator car.

Exemplary embodiments of the invention also include an elevator system comprising at least one elevator car according to an exemplary embodiment of the invention.

Exemplary embodiments of the invention further include a method of providing access to an interior space of an elevator car. The method includes attaching a control element to a decorative ceiling of the elevator car and using the control element for controllably moving the decorative ceiling from its closed position into an open position. The method in particular may include controlling the movement of the decorative ceiling from a position outside the elevator car, e.g. from a position above/on top of the elevator car.

Exemplary embodiments of the invention allow evacuating an elevator car comprising a decorative ceiling from the top of the elevator car. Evacuating the elevator car according to exemplary embodiments of the invention is easier, faster and safer than alternative ways of evacuating the elevator car. Exemplary embodiments of the invention may be realized simply using relatively inexpensive components.

A number of optional features are set out in the following. These features may be realized in particular embodiments, alone or in combination with any of the other features, unless specified otherwise.

The elevator car may comprise a locking mechanism configured for locking the decorative ceiling in its closed position in order to prevent the decorative ceiling from unintentionally moving from its closed position into an open position.

The locking mechanism may be unlockable from outside the elevator car, in particular from the top of the elevator car, in order to allow providing access to the elevator car from outside the elevator car.

The locking mechanism may be unlockable from inside the elevator car, too. In an alternative configuration, the locking mechanism may be unlockable only from outside the elevator car, in particular from the top of the elevator car.

In case the elevator car is provided with a locking mechanism, the method of providing access to the interior space of an elevator car may additionally comprise unlocking the locking mechanism.

In order to allow unlocking the locking mechanism from the top of the elevator car, the structural ceiling may comprise at least one opening providing access to the locking mechanism for unlocking the locking mechanism.

The control element may comprise a longitudinal element, such as a strap, a belt, a cable or a rope. The longitudinal element may be made of leather, cotton or a synthetic material. The longitudinal element may be rollable for allowing space-savingly storing the longitudinal element when it is not used.

The control element may comprise at least one opening which allows fixing the control element to the structural ceiling and/or to the decorative ceiling e.g. by means of a fixing element, such as a screw, extending through the at least one opening.

The elevator car may comprise at least on connection element, such as a bar or a bracket, mounted to an end of the control element. The connection element may extend transversely, in particular orthogonally, to the extension of the longitudinal element. The connection element may be configured for being selectively fixed to the structural ceiling or to the decorative ceiling, respectively.

The connection element may be fixed to the structural ceiling when the control element is not used for controlling movement of the decorative ceiling. The connection element may be fixed to the decorative ceiling before unlocking the decorative ceiling for controlling movement of the decorative ceiling after it has been unlocked.

The elevator car may further comprise a security element, in particular a security cable, extending between the connection element and the decorative ceiling in order to prevent the decorative ceiling from unintentionally falling into the interior space of the elevator car when the unlocking mechanism is unlocked with the control element not being attached to the decorative ceiling, in particular when the unlocking mechanism is unlocked from inside the elevator car.

The elevator car may further comprise at least one receiving element securely mounted, or formed integrally with, to the structural ceiling and being configured for receiving and being connected to the control element and/or for receiving and being connected to a connection element mounted to the control element. The control element and/or the connection element may be fixable to the receiving element by means of a screw. This allows securely storing the connection element and the control element in the top of the elevator car when they are not used for controlling movement of the decorative ceiling.

The structural ceiling may comprise at least one opening allowing the control element to extend from an area on the top of the structural ceiling to the decorative ceiling below the structural ceiling. This allows using the control element for controlling movement of the decorative ceiling from an area on the top of the structural ceiling.

The method of providing access to the interior space of an elevator car may additionally comprise using the control element for moving the decorative ceiling from the open position into its closed position. This provides a convenient way of moving the decorative ceiling from the open position into its closed position after the elevator car has been evacuated.

DRAWING DESCRIPTION

In the following, exemplary embodiments of the invention are described in more detail with respect to the enclosed figures:

FIG. 1 schematically depicts an elevator system with an elevator car according to an exemplary embodiment of the invention.

DETAILED DESCRIPTION

Figure 1:
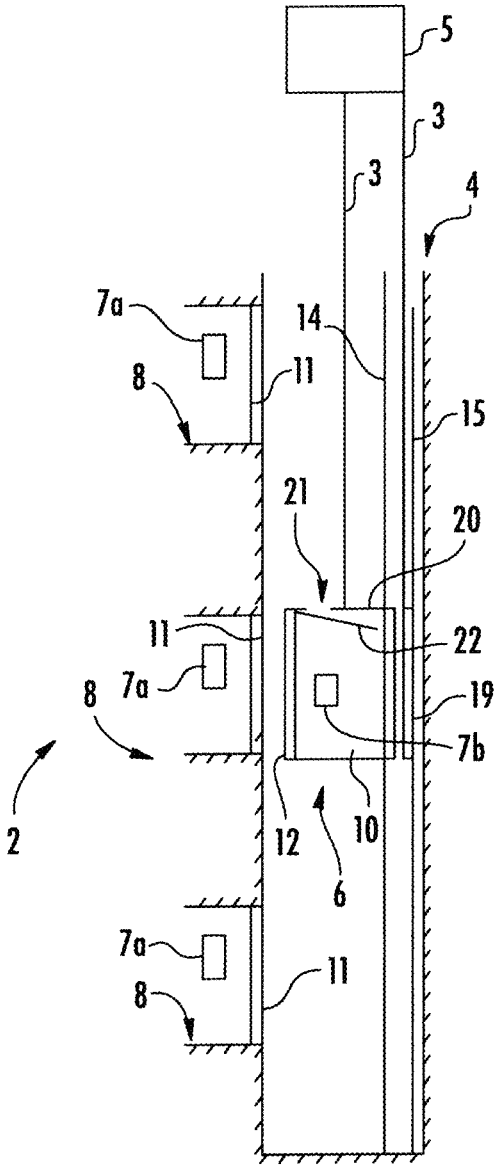

FIG. 1 schematically depicts an elevator system 2 according to an exemplary embodiment of the invention.

The elevator system 2 includes an elevator car 6 movably arranged within a hoistway 4 extending between a plurality of landings 8. The elevator car 6 in particular is movable along a plurality of car guide members 14, such as guide rails, extending along the longitudinal (vertical) direction of the hoistway 4. Only one of said car guide members 14 is visible in FIG. 1.

Although only one elevator car 6 is depicted in FIG. 1, the skilled person will understand that exemplary embodiments of the invention may include elevator systems 2 having a plurality of elevator cars 6 moving in one or more hoistways 4.

The elevator car 6 is movably suspended by means of a tension member 3. The tension member 3, for example a rope or belt, is connected to a drive unit 5, which is configured for driving the tension member 3 in order to move the elevator car 6 along the height of the hoistway 4 between the plurality of landings 8, which are located on different floors.

Each landing 8 is provided with a landing door 11, and the elevator car 6 is provided with a corresponding elevator car door 12 for allowing passengers to transfer between a landing 8 and the interior of the elevator car 6 when the elevator car 6 is positioned at the respective landing 8.

The exemplary embodiment shown in FIG. 1 uses a 1:1 roping for suspending the elevator car 6. The skilled person, however, easily understands that the type of the roping is not essential for the invention and different kinds of roping, e.g. a 2:1 roping or a 4:1 roping may be used as well.

The elevator system 2 includes further a counterweight 19 attached to the tension member 3 and moving concurrently and in opposite direction with respect to the elevator car 6 along at least one counterweight guide member 15. The skilled person will understand that the invention may be applied also to elevator systems 2 which do not comprise a counterweight 19.

The tension member 3 may be a rope, e.g. a steel wire rope, or a belt. The tension member 3 may be uncoated or may have a coating, e.g. in the form of a polymer jacket. In a particular embodiment, the tension member 3 may be a belt comprising a plurality of polymer coated steel cords (not shown). The elevator system 2 may have a traction drive including a traction sheave for driving the tension member 3.

Instead of a traction drive, a hydraulic drive or a linear drive may be employed for driving the tension member 3. In an alternative configuration, which is not shown in the figures, the elevator system 2 may be an elevator system 2 without a tension member 30, comprising e.g. a hydraulic drive or a linear drive configured for driving the elevator car 6 without using a tension member 3. The elevator system 2 may have a machine room (not shown) or may be a machine room-less elevator system.

The drive unit 5 is controlled by an elevator control unit (not shown) for moving the elevator car 6 along the hoistway 4 between the different landings 8.

Input to the control unit may be provided via landing control panels 7*a*, which are provided on each landing 8 close to the landing doors 11, and/or via an elevator car control panel 7*b*, which is provided inside the elevator car 6.

The landing control panels 7*a* and the elevator car control panel 7*b* may be connected to the elevator control unit by means of electric wires, which are not shown in FIG. 1, in particular by an electric bus, or by means of wireless data connections.

The elevator car 6 defines an interior space 10 for accommodating passengers and/or cargo. A structural ceiling 20 of the elevator car 6 is arranged on the top of the interior space 10. A decorative ceiling 22 is arranged below the structural ceiling 20 providing a pleasant appearance to passengers within the interior space 10. Lighting devices (not shown) for illuminating the interior space 10 and/or ventilation devices (not shown) may be arranged between the structural ceiling 20 and the decorative ceiling 22.

For providing additional/alternative access to the interior space 10 of the elevator car 6, in particular in an emergency situation, a rescue opening 21 is formed within the structural ceiling 20. The decorative ceiling 22 is movable with respect to the structural ceiling 20 in order to allow accessing and/or leaving the interior space 10 of the elevator car 6 via the rescue opening 21. The skilled person understands that more than one rescue opening 21 and/or more than one movable decorative ceiling 22 may be provided.

In the exemplary embodiment depicted in the figures, the decorative ceiling 22 is pivotable between a closed position in which it extends basically parallel to the structural ceiling 20, and at least one open position in which it extends from the decorative ceiling 22 into the interior space 10. In FIG. 1, the decorative ceiling 22 is arranged in an intermediate position, i.e. a position in between the closed position and an open position.

Figure 2:
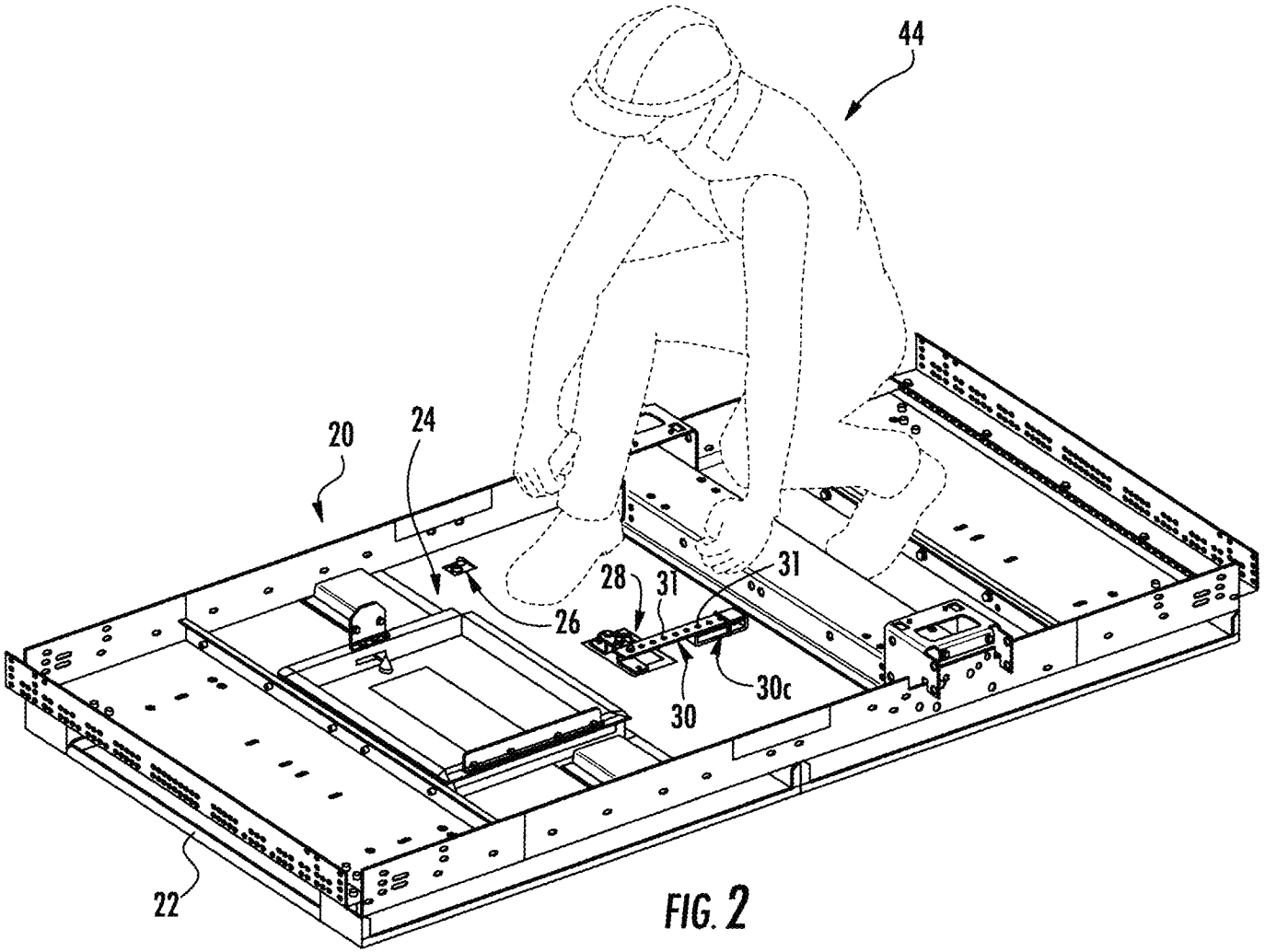
FIG. 2 depicts a perspective view of a ceiling of the elevator car.

FIG. 2 depicts a perspective view of the top of the elevator car 6. Only the structural ceiling 20 and the decorative ceiling 22 of the elevator car 6 are shown in FIG. 2.

Figure 9:
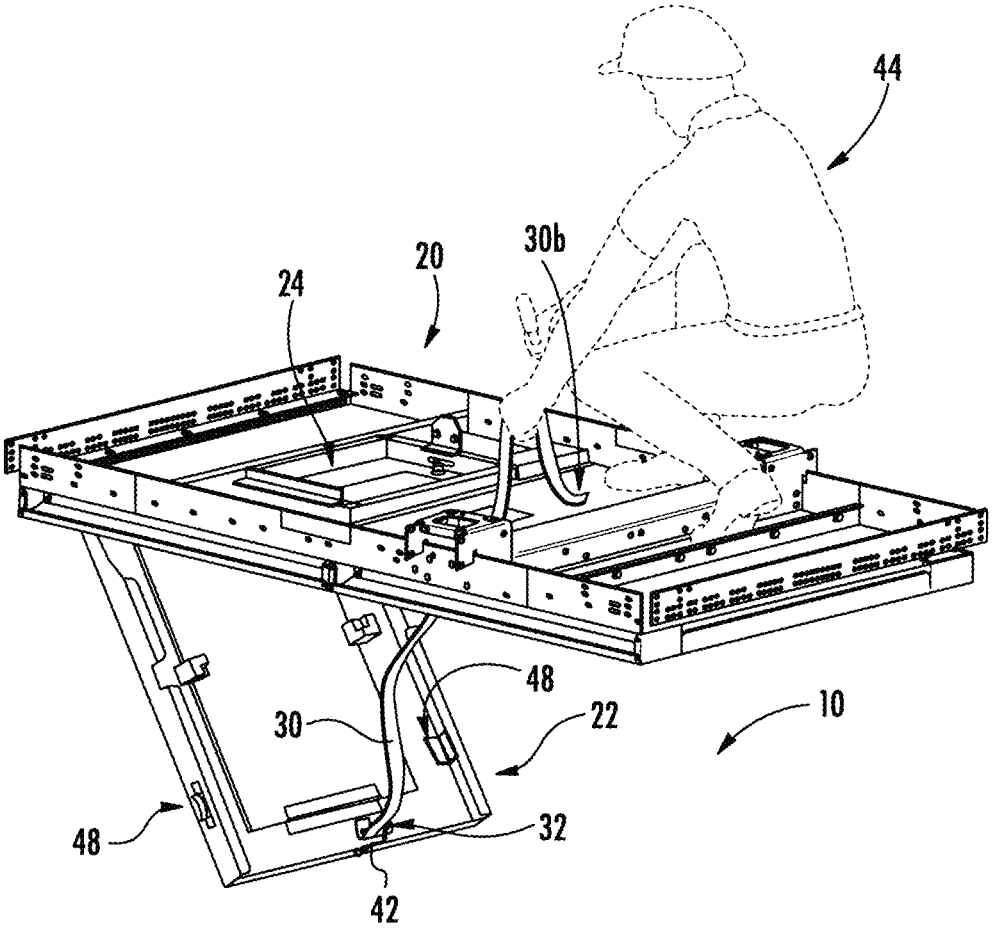
FIG. 9 depicts a mechanic lowering the decorative ceiling using the control element.
Figure 10:
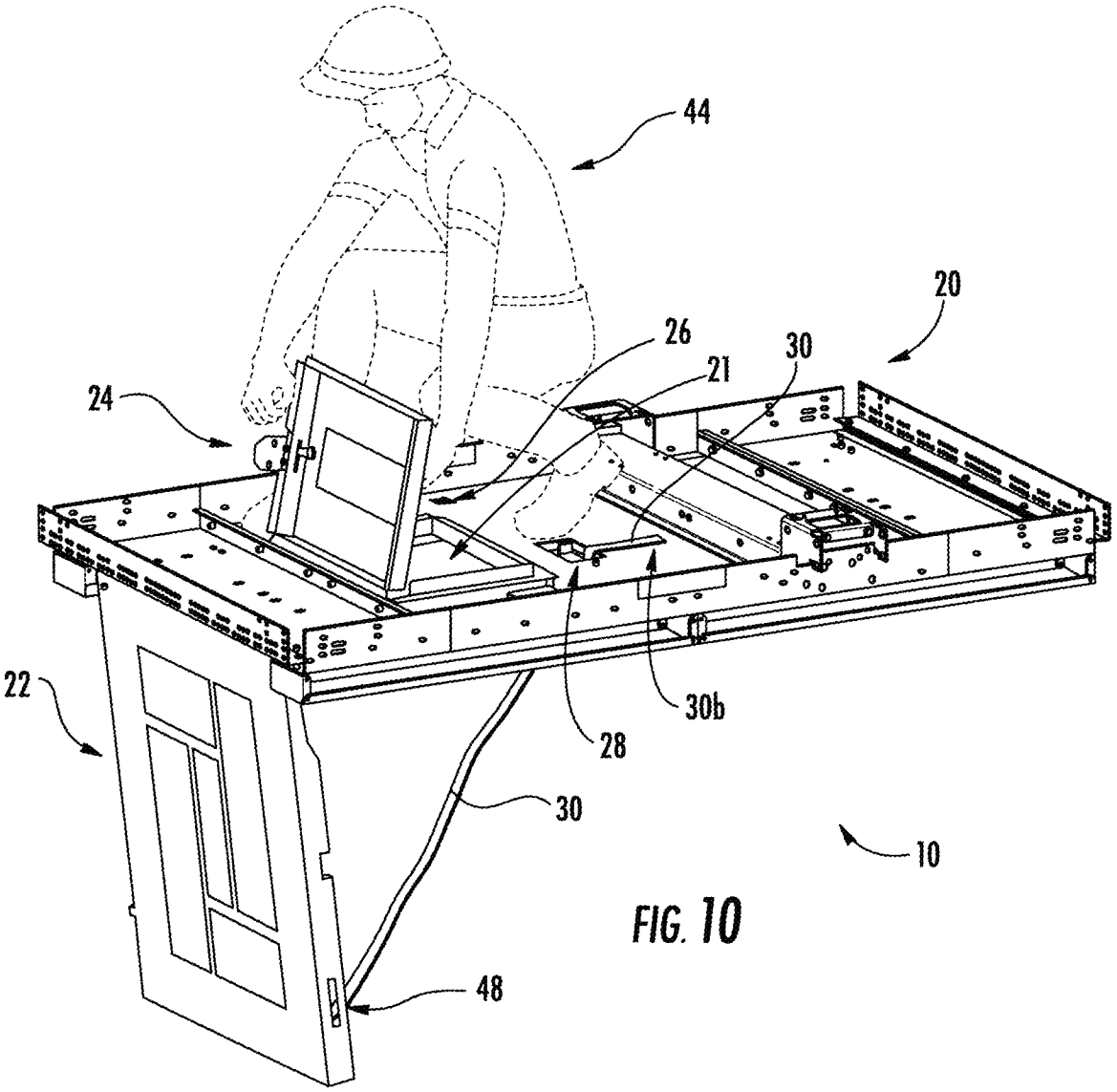
FIGS. 10 and 11 depict a person opening a rescue flap of the elevator car.
Figure 11:
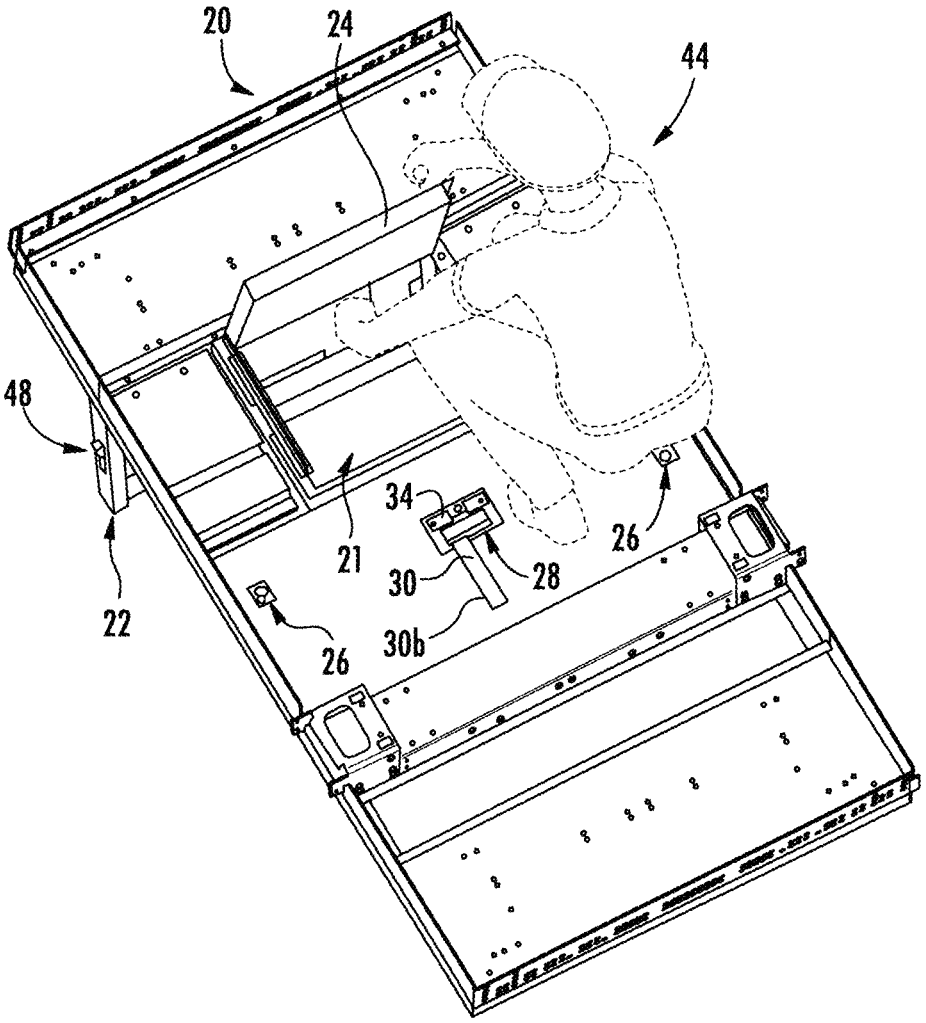

In FIG. 2, the rescue opening 21 formed within the structural ceiling 20 is not visible as it is closed by a rescue flap 24. The decorative ceiling 22 is arranged in its closed position extending basically parallel to the structural ceiling 20. Thus, only an end portion of the decorative ceiling 22 is visible on the left side of FIG. 2. The decorative ceiling 22 is locked in said closed position by at least one locking mechanism 48, which is not visible in FIG. 2. The locking mechanisms 48 are shown in FIGS. 9, 10, and 11.

In the depicted exemplary embodiment, a locking mechanism 48 is provided at each lateral side of the decorative ceiling 22, respectively. Unlocking openings 26 are formed in the structural ceiling 20 allowing a person 44, such as a rescue person and/or mechanic, to access the locking mechanisms 48 via the unlocking openings 26 for unlocking the locking mechanisms 48 from the top of the elevator car 6. Due to the perspective of FIG. 2, only a single unlocking opening 26 is visible. The second unlocking opening 26 is visible in FIG. 11.

The locking mechanisms 48 may be unlockable from inside the elevator car 6, too. In an alternative configuration, the locking mechanisms 48 may be unlockable only from outside the elevator car 6, in particular from the top of the elevator car 6.

A control element (tension element) 30 is provided on top of the structural ceiling 20. In the exemplary embodiment depicted in the figures, the control element 30 is a strap or belt, having a longitudinal extension and comprising a plurality of openings 31 spaced apart from each other along the longitudinal extension of the control element 30. The control element 30 may be made of cotton, leather, or a synthetic material.

A control opening 28 providing access to a portion of the decorative ceiling 22 from the top of the elevator car 6 is formed within the structural ceiling 20.

Figure 3:
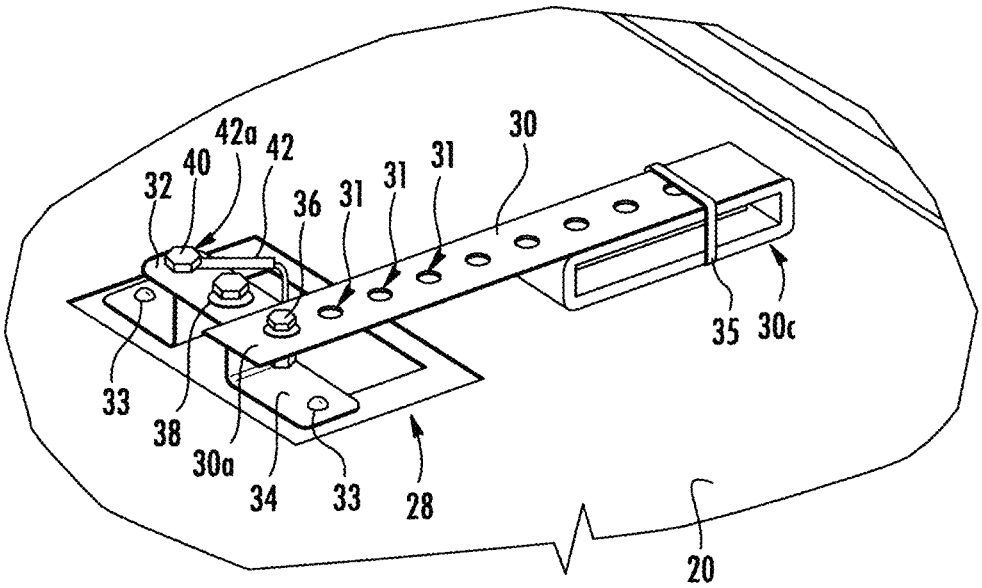
FIGS. 3 and 4 depict enlarged perspective views of an area next to a control opening formed in a structural ceiling of the elevator car.
Figure 4:
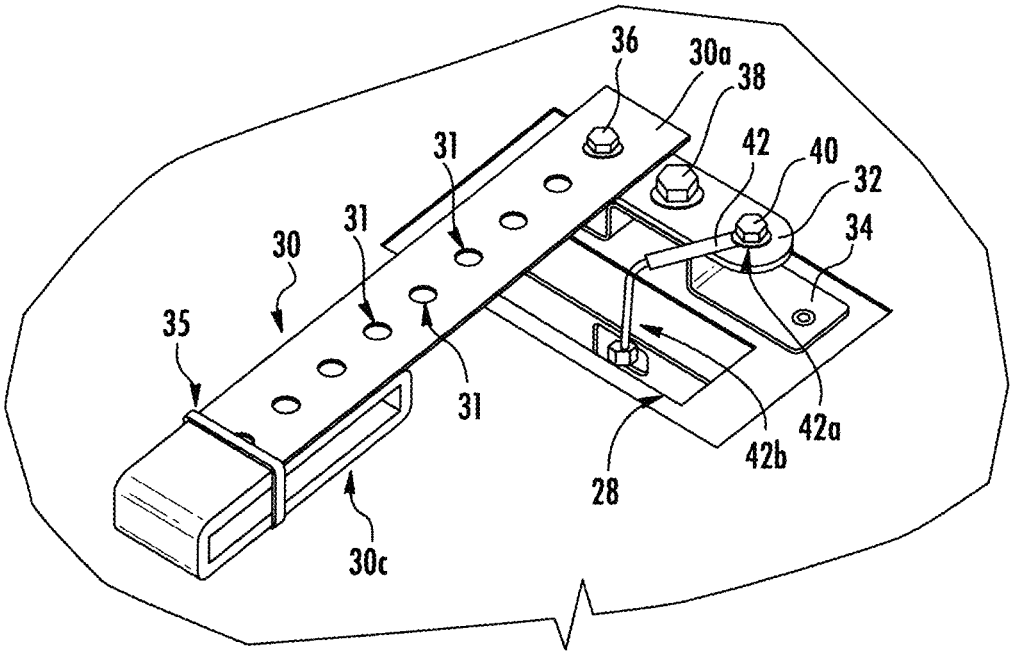

FIGS. 3 and 4 depict enlarged perspective views of an area next to the control opening 28, respectively.

When not used, the control element 30 is at least partially wound up. The wound-up portion 30*c* of the control element 30 is fixed to the structural ceiling 20 by a clamp 35.

A connection element (removable bracket) 32 is fixed to a first end 30*a* of the control element 30 extending from the wound-up portion 30*c* by a first fixing element 36, e.g. by a first screw, extending through the connection element 32 and one of the openings 31 formed within the control element 30.

In the exemplary embodiment depicted in the figures, the connection element 32 is formed as a flat bar extending basically orthogonally to the longitudinal direction of the control element 30. The connection element 32 is fixed by a second fixing element 38, e.g. by a second screw, to a receiving element (fixed bracket) 34 which is securely mounted, e.g. by rivets 33, to the structural ceiling 22.

In the embodiment depicted in the figures, the receiving element 34 comprises two base legs extending parallel to each other and being fixed to the structural ceiling 20, two vertical legs, each vertical leg extending basically perpendicularly to one of the base legs, and a central leg extending basically parallel to the base legs between the ends of the vertical legs opposite to the base legs.

An opening, which not visible in the figures, is formed within the central leg allowing the second fixing element 38 to extend through the connection element 32 and the central leg of the receiving element 34 for securely fixing the connection element 32 to the receiving element 34.

A third fixing element 40, e.g. a third screw, fastens a first end 42*a* of a security element 42, in particular a security cable, to the connection element 32. An opposing second end 42*b* of the security element 42 is fixed to the decorative ceiling 22 as shown in FIG. 4.

In consequence, when the receiving element 34 is fixed to the structural ceiling 20 as shown in FIGS. 2 to 4, the security element 42 prevents the decorative ceiling 22 from dropping/pivoting into the interior space 10 of the elevator car 6, when the locking mechanisms 48 are unlocked with the control element 30 not being attached to the decorative ceiling 22, in particular when the unlocking mechanisms 48 are unlocked from the interior space 10 of the elevator car 6. This reduces the risk of hurting people located within the elevator car 6.

The second end 42*b* of the security element 42 may be detached from the decorative ceiling 22 from a position inside the interior space 10 in order to allow lowering the decorative ceiling 22 from inside the elevator car 6 for maintenance and/or repair of components (not shown) arranged between the structural ceiling 20 and the decorative ceiling 22. These components in particular may include components configured for illuminating and/or ventilating the interior space.

For providing access to the interior space 10 of the elevator car 6 from a position above the elevator car 6, a person 44 being present on top of the elevator car 6 loosens the second fixing element 38 (see FIGS. 5 and 6) and separates the connection element 32 from the receiving element 34.

Figure 7:
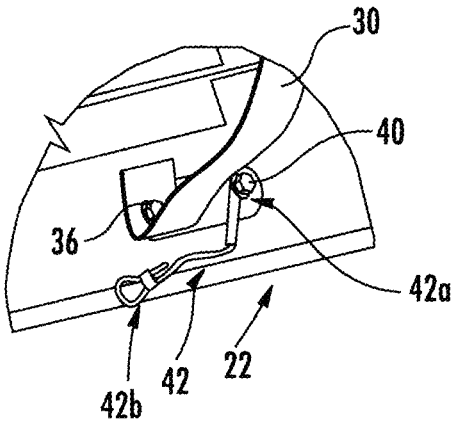
FIG. 7 depict the control element attached to a decorative ceiling of the elevator car.

Afterwards, the person 44 attaches the connection element 32 to the decorative ceiling 22 via the control opening 28 formed within the structural ceiling 20. FIG. 7 shows the connection element 32 attached to the decorative ceiling 22.

When the connection element 32 is attached to the decorative ceiling 22, both ends 42*a*, 42*b* of the security element 42 are connected to the decorative ceiling 22. In consequence, the security element 42 does not prevent the decorative ceiling 22 from pivoting into the interior space 10 of the elevator car 6 anymore.

The connection element 32 may be fixed to the decorative ceiling 22 using a second fixing element 38 (screw) or by an alternative fixing mechanism, such as a clamping mechanism.

Figure 5:
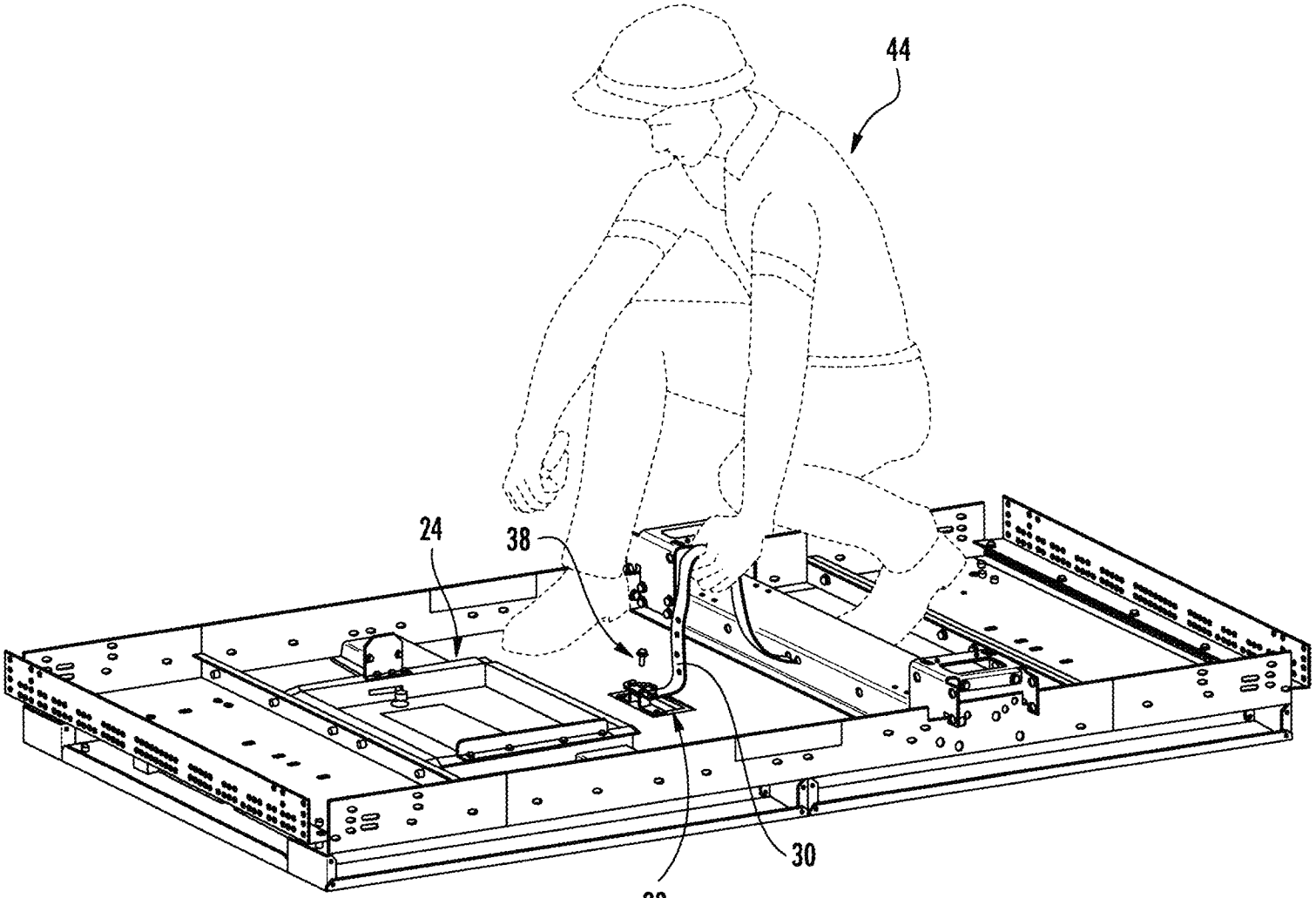
FIGS. 5 and 6 depict a mechanic detaching a control element from the structural ceiling of the elevator car.
Figure 6:
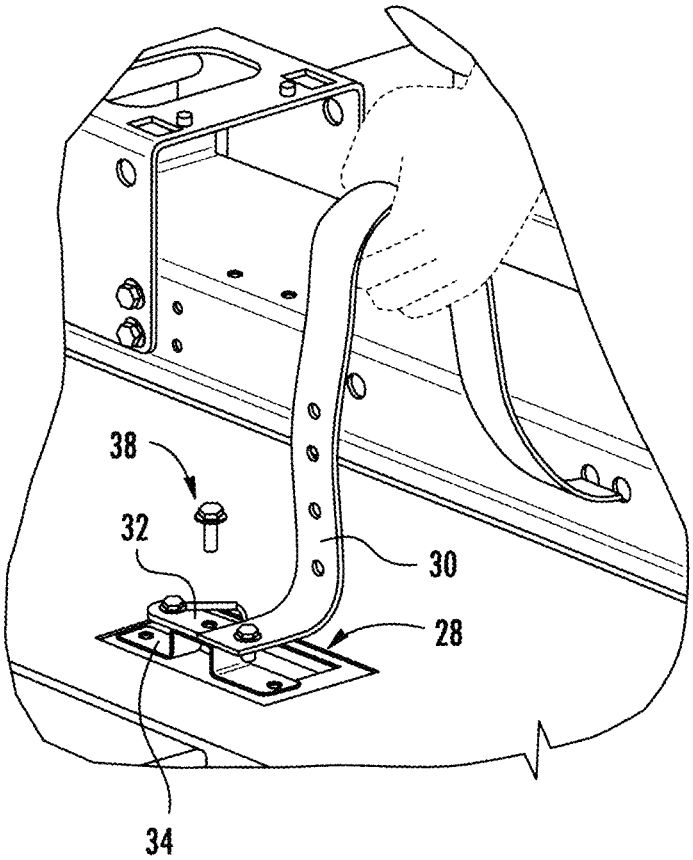

After the connection element 32 has been fixed to the decorative ceiling 22, the person 44 may use the control element 30 for controlling movement of the decorative ceiling 22. The person 44 in particular grabs the control element 30, as shown in FIGS. 5 and 6.

Figure 8:
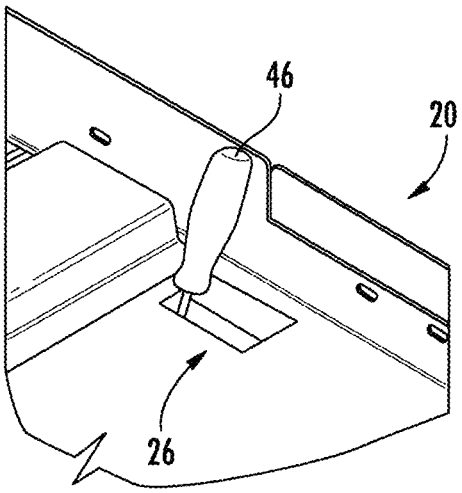
FIG. 8 depicts unlocking a locking mechanism of a decorative ceiling of the elevator car.

The person 44 then unlocks the locking mechanisms 48 by introducing an appropriate tool 46, such as a screwdriver, into the unlocking openings 26 formed within the structural ceiling 20 (see FIG. 8).

As soon as the locking mechanisms 48 have been unlocked, the decorative ceiling 22 is prevented from pivotably dropping into the interior space 10 of the elevator car 6 only by the control element 30 held by the person 44. Using the control element 30, the person 44 now carefully lowers the decorative ceiling 22 from its closed position depicted in FIG. 2 into an open position in which the decorative ceiling 22 extends into the interior space 10 of the elevator car 6 (see FIG. 9). The control element 30 extends through the control opening 28 formed within the structural ceiling 20.

After the decorative ceiling 22 has been lowered into its final open position extending nearly perpendicularly from the structural ceiling 20, the person 44 fixes a second (upper) end 30*b* of the control element 30 to the structural ceiling 20, e.g. using one of the openings 31 formed within the control element 30, in order to prevent the second (upper) end 30*b* of the control element 30 from falling into the interior space 10.

Preventing the second end 30*b* of the control element 30 from falling into the interior space 10 is not a safety issue, but it facilitates raising the decorative ceiling 22 back into its closed position, as will be described further below.

The person 44 then opens the rescue flap 24, which closes the rescue opening 21 formed within the structural ceiling 20 (see FIGS. 10 and 11). This allows the person 44 to access the interior space 10 of the elevator car 6; it in particular allows entering into the interior space 10 and/or evacuating passengers from said interior space 10 via the rescue opening 21.

The skilled person understands that in an alternative configuration the rescue flap 24 may be opened before the decorative ceiling 22 is lowered into the interior space 10.

After the person 44 has left the interior space 10 and/or all passengers have been evacuated from the elevator car 6, the person 44 may raise the decorative ceiling 22 from its open position back into its closed position depicted in FIG. 2 by grabbing and pulling the second end 30*b* of the control element 30.

Exemplary embodiments of the invention allow evacuating the elevator car 6 comprising a decorative ceiling 22 from the top of the elevator car 6. Evacuating the elevator car 6 according to the invention is easier, faster and safer than alternative ways of evacuating the elevator car 6. An elevator car 6 according to an exemplary embodiment of the invention may be realized simply using relatively inexpensive components.

While the invention has been described with reference to exemplary embodiments, it will be understood by those skilled in the art that various changes may be made and equivalents may be substituted for elements thereof without departing from the scope of the invention. In addition, many modifications may be made to adopt a particular situation or material to the teachings of the invention without departing from the essential scope thereof. Therefore, it is intended that the invention shall not be limited to the particular embodiment disclosed, but that the invention includes all embodiments falling within the scope of the dependent claims.

REFERENCES

2 elevator system
3 tension member
4 hoistway
5 drive unit
7*a* landing control panel
7*b* elevator car control panel
8 landing
10 interior space
11 landing door
12 elevator car door
14 car guide member
15 counterweight guide member
19 counterweight
20 structural ceiling
21 rescue opening
22 decorative ceiling
24 rescue flap
26 unlocking opening
28 control opening
30 control element
30*a* first end of the control element
30*b* second end of the control element
30*c* wound-up portion of the control element
31 opening
32 connection element
33 rivet
34 receiving element
35 clamp
36 first fixing element
38 second fixing element
40 third fixing element
42 security element
42*a* first end of the security element
42*b* second end of the security element
44 person
46 tool
48 locking mechanism

What is claimed is:

1. Elevator car comprising:

an interior space for accommodating passengers and/or cargo;

a structural ceiling arranged at the top of the elevator car with a rescue opening formed within the structural ceiling;

a decorative ceiling arranged below the structural ceiling within the interior space; wherein the decorative ceiling is movable between a closed position in which it extends basically parallel to the structural ceiling; and at least one open position in which it extends into the interior space;

a control element which is selectively attachable to the structural ceiling and to the decorative ceiling, respectively, wherein the control element, when attached to the decorative ceiling, is configured for allowing a person located on top of the elevator car to move the decorative ceiling between its closed position and at least one open position in a controlled manner;

a connection element mounted to a first end of the control element, the connection element configured for being selectively fixed to the decorative ceiling when the decorative ceiling is in the open position and to the structural ceiling when the decorative ceiling is in the closed position;

a security element extending between the connection element and the decorative ceiling.

2. Elevator car according to claim 1, further comprising a rescue flap configured for selectively closing the rescue opening.

3. Elevator car according to claim 1, wherein the control element comprises a longitudinal element.

4. Elevator car according to claim 1, wherein the control element comprises at least one opening for fixing the control element to the structural ceiling and/or to the decorative ceiling by means of a fixing element extending through the at least one opening.

5. Elevator car according to claim 1, further comprising at least one receiving element securely mounted to, or formed integrally with, the structural ceiling and being configured for receiving and being connected to the control element and/or a connection element mounted to the control element.

6. Elevator car according to claim 5, wherein the control element and/or the connection element are fixable to the receiving element by means of a first fixing element.

7. Elevator car according to claim 1, wherein the structural ceiling comprises at least one control opening allowing the control element to extend from the top of the structural ceiling to the decorative ceiling located below the structural ceiling.

8. Elevator system comprising an elevator car according to claim 1.

9. Elevator car according to claim 1, wherein the control element comprises a strap, a belt, a cable or a rope.

10. Method of providing access to the interior space of an elevator car according to claim 1, wherein the method includes:

attaching the control element to the decorative ceiling; and using the control element for controllably moving the decorative ceiling from its closed position into an open position.

11. Method of claim 10, wherein the method further includes using the control element for moving the decorative ceiling from the open position into its closed position.

12. Elevator car according to claim 1, further comprising a locking mechanism, configured for locking the decorative ceiling in it closed position, wherein the locking mechanism is unlockable from outside the elevator car, in particular from the top of the elevator car.

13. Elevator car according to claim 12, wherein the structural ceiling comprises at least one unlocking opening providing access to the locking mechanism for unlocking the decorative ceiling.

14. Method of providing access to the interior space of an elevator car according to claim 12, wherein the method includes:

attaching the control element to the decorative ceiling;

unlocking the locking mechanism; and using the control element for controllably moving the decorative ceiling from its closed position into an open position.

* * * * *